US008737899B2

(12) United States Patent
Katano et al.

(10) Patent No.: US 8,737,899 B2
(45) Date of Patent: May 27, 2014

(54) FIXING LIQUID, FIXING METHOD, FIXING UNIT, IMAGE FORMING METHOD, AND IMAGE FORMING APPARATUS

(75) Inventors: Yasuo Katano, Kanagawa (JP); Tsuneo Kurotori, Tokyo (JP); Tomoyasu Hirasawa, Kanagawa (JP); Tomoaki Sugawara, Kanagawa (JP); Takuma Nakamura, Kanagawa (JP); Yuko Arizumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 361 days.

(21) Appl. No.: 12/922,909

(22) PCT Filed: Apr. 3, 2009

(86) PCT No.: PCT/JP2009/057308

§ 371 (c)(1),
(2), (4) Date: Sep. 16, 2010

(87) PCT Pub. No.: WO2009/125824

PCT Pub. Date: Oct. 15, 2009

(65) Prior Publication Data

US 2011/0013957 A1 Jan. 20, 2011

(30) Foreign Application Priority Data

Apr. 10, 2008 (JP) ..... 2008-102005

(51) Int. Cl.
*G03G 15/20* (2006.01)

(52) U.S. Cl.
CPC ..... *G03G 15/2096* (2013.01)
USPC ..... 399/340; 399/321

(58) Field of Classification Search
CPC ..... G03G 15/2096; G03G 15/2025
USPC ..... 399/321, 340
See application file for complete search history.

(56) References Cited

U.S. PATENT DOCUMENTS

| | | | | |
|---|---|---|---|---|
| 5,666,628 | A | 9/1997 | Fukai | |
| 2004/0131402 | A1 | 7/2004 | Kurotori et al. | |
| 2008/0063446 | A1 * | 3/2008 | Katano et al. | 399/340 |
| 2009/0003903 | A1 * | 1/2009 | Katano et al. | 399/340 |
| 2009/0067904 | A1 | 3/2009 | Katano et al. | |

FOREIGN PATENT DOCUMENTS

| | | |
|---|---|---|
| EP | 2 009 515 A2 | 12/2008 |
| JP | 59 119364 | 7/1984 |
| JP | 7 44034 | 2/1995 |
| JP | 8 72386 | 3/1996 |
| JP | 2004 109747 | 4/2004 |
| JP | 2004 109749 | 4/2004 |
| JP | 2004 333866 | 11/2004 |
| JP | 2007 219105 | 8/2007 |
| JP | 2008 58550 | 3/2008 |

OTHER PUBLICATIONS

Ishi, Toshio: "Concepts in Basic Bubble and Foam Engineering (1st Edition)", Techno System Corporation, p. 489, (Mar. 25, 2005), (with partial English translation).

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

Disclosed is a fixing liquid containing a softening agent that softens resin-containing fine particles by dissolving or swelling at least a part of the resin; a C12-C18 fatty acid; and a C12-C18 fatty acid salt. The fixing liquid is mixed with water serving as a dilution solvent.

7 Claims, 8 Drawing Sheets

FIXING LIQUID, FIXING METHOD, FIXING UNIT, IMAGE FORMING METHOD, AND IMAGE FORMING APPARATUS

TECHNICAL FIELD

The present invention relates to a fixing liquid, a fixing method, a fixing unit, an image forming method, and an image forming apparatus and, in particular, to a fixing liquid for fixing resin-containing fine particles to a medium, and a method and a unit for fixing toner as resin-containing fine particles.

BACKGROUND ART

Image forming apparatuses as represented by printers, facsimile machines, and copiers are used for forming images including characters and symbols on recording media such as sheets, fabrics, and OHP sheets based on image information. Particularly, electrophotographic image forming apparatuses have become widespread at offices because they can form high-definition images on plain sheets. Such electrophotographic image forming apparatuses generally use a heat fixing method in which toner on a recording medium is heated and melted and the melted toner is then pressurized to fix the toner to the recording medium. This heat fixing method has been preferably used because it can provide high fixing speed, high fixing image quality, etc.

However, approximately more than half of power consumption in such electrophotographic image forming apparatuses is caused when toner is heated in the heat fixing method. On the other hand, from the viewpoint of solving environmental problems in recent years, low power consumption (energy-saving) fixing units have been demanded. In other words, a fixing method, which greatly lowers temperature for heating toner to fix toner more than ever before or which does not require heating the toner at all, has been demanded. Particularly, it is ideal to provide a non-heating fixing method for fixing toner to a recording medium without heating the toner at all from the viewpoint of low power consumption.

As such a non-heating fixing method, Patent Document 1 has proposed a wet fixing method. Specifically, in this wet fixing method, an oil-in-water type fixing agent, which is capable of dissolving or swelling toner and in which a water-soluble or poor water-soluble organic compound is dispersed and mixed in water, is sprayed or dropped from the front surface of an object to be fixed on which unfixed toner particles are placed at a given position so as to dissolve or swell the toner, and then the object to be fixed is dried.

However, the wet fixing method of Patent Document 1 uses the oil-in-water type fixing agent in which the water-soluble or poor water-soluble organic compound is dispersed and mixed in water. Therefore, when a large amount of fixing agent is applied to the unfixed toner particles, a recording medium (object to be fixed) such as a transfer sheet absorbs water of the fixing agents, thereby being wrinkled or curled. As a result, stable and high-speed conveyance of the recording medium needed for an image forming apparatus is remarkably degraded. To this end, when the large amount of water included in the fixing agents is evaporated with a drying unit to remove the water of the fixing agents applied to the recording medium, the power equivalent to the power consumption of the image forming apparatus using the heat fixing method is needed. Furthermore, as water-repellent fixing liquids that reject unfixed toner particles, some oily fixing liquids have been proposed in which a material that causes toner to be dissolved or swelled is dissolved in an oily solvent. By way of example, Patent Document 2 has proposed a fixing liquid in which an aliphatic dibasic acid ester, which has a material that causes a resin component constituting toner to be dissolved or swelled as an component, is diluted (dissolved) with non-volatile dimethyl silicon serving as a dilution liquid (solvent). Furthermore, as a fixing liquid used for a fixing method in which an unfixed image formed with an electrostatic method can be clearly and easily fixed to an image receiving sheet without causing irregularities in an image, Patent Document 3 has proposed a fixing liquid for a compatible unfixed toner image in which 8 through 120 parts by volume of silicon oil are mixed in 100 parts by volume of a solvent that dissolves toner and has compatibility with the silicon oil. Such an oily fixing liquid includes an oily solvent having a high affinity for water-repellent toner. Therefore, the oily fixing liquid can cause toner to be dissolved or swelled without rejecting the water-repellent toner and fix the toner to a recording medium.

Patent Documents 1 through 3 disclose inventions in which a fixing liquid is configured to be applied to an toner layer. Here, as shown in FIGS. 1A and 1B, the fixing liquid is applied to the toner layer 83 on the recording medium 82 with a coating roller 81 serving as a contact application unit. When a fixing liquid layer 84 on the coating roller 81 is made thinner than the toner layer 83 for applying a small amount of fixing liquid to the recording medium 82, unfixed toner particles are pulled up by the surface tension due to the liquid film of the fixing liquid on the front surface of the coating roller 81 at the position where the coating roller 81 is separated from the recording medium 82. Therefore, the toner particles are offset on the front surface of the coating roller 81, which causes much irregularities in an image on the recording medium.

Conversely, when the fixing liquid layer 84 on the coating roller 81 is made sufficiently thicker than the toner layer 83, the surface tension due to the liquid film on the front surface of the coating roller 81 is not likely to directly act on the toner particles at the position where the coating roller 81 is separated from the recording medium 82, thereby preventing the offset of the toner particles on the side of the coating roller 81. However, in this case, a large amount of fixing liquid is applied to the surface of the recording medium 82, which results in the toner particles flowing over the recording medium 82 due to the excessive fixing liquid which causes degradation in image quality or takes a long time for drying the fixing liquid which causes a problem in fixing response. In addition, a remarkable residual liquid feeling (wet feeling at the time of touching the recording medium 82 by hand) is caused on the recording medium 82. Moreover, when a large amount of fixing liquid containing water is applied to the recording medium such as a sheet containing cellulose, the recording medium is remarkably curled, which may cause jamming when the medium is conveyed, for example, in an image forming apparatus. Accordingly, when the fixing liquid is applied to the recording medium with the coating roller 81, it is really hard not only to apply a small amount of fixing liquid to the toner layer on the recording medium but also prevent the offset of the toner particles to the fixing roller so as to improve the fixing response, reduce the residual liquid feeling, and prevent the recording medium from being curled. Even if a die-coat unit, a blade coating unit, or a wire bar coating unit is used as the contact application unit, toner particles are caused to adhere onto the fixing roller due to the surface tension when a small amount of fixing liquid is applied, thereby causing degradation in image quality.

As described above, in the conventional method for applying the fixing liquid, it is really hard not only to apply the small amount of fixing liquid to the toner layer on the recording medium so as to improve the fixing response but also to uniformly apply the fixing liquid without causing the irregularities in a toner image with the contact application unit. This problem is not limited to the toner on the recording medium, but it could occur in any case where an aquiform fixing liquid is applied to the layer of resin-containing fine particles on a recording medium.

According to Patent Document 4 having been proposed to solve these problems, a foamed fixing liquid is applied to resin-containing fine particles of toner, etc., on a medium such as a sheet. Accordingly, after the fixing liquid is applied to the medium on which the resin-containing fine particles adhere, the resin-containing fine particles are quickly fixed to the medium.

Patent Document 1: JP-B2-3290513
Patent Document 2: JP-A-2004-109749
Patent Document 3: JP-A-59-119364
Patent Document 4: JP-A-2007-219105
Non-Patent Document 1: P.489, first edition of "Concepts in Basic Bubble and Foam Engineering" written by Toshio Ishi and published on Mar. 25, 2005, by Techno system Corporation However, a softening agent contained in the fixing liquid has a strong defoaming effect. Therefore, as the concentration of the softening agent in the fixing liquid increases, the foaming property and the foaming stability of the fixing liquid are degraded. As a result, foams are hardly generated. In addition, a foamed fixing liquid having low foam density cannot be obtained because foams easily disappear.

DISCLOSURE OF INVENTION

The present invention has been made to solve the above problems and may provide a fixing liquid for fixing resin-containing fine particles. The fixing liquid contains a highly-concentrated softening agent and is foamed to have an extremely low density. When the fixing liquid is applied to a medium onto which the resin-containing fine particles adhere, the resin-containing fine particles are quickly fixed to the medium without causing turbulence in the resin-containing fine particles of toner on the medium such as a sheet. Moreover, the fixing liquid can be applied in a small amount so as not to cause a residual liquid feeling on the medium. In addition, the present invention provides a fixing method, a fixing unit, an image forming method, and an image forming apparatus using the fixing liquid.

According to a first aspect of the present invention, there is provided a fixing liquid containing a softening agent that softens resin-containing fine particles by dissolving or swelling at least a part of the resin; a C12-C18 fatty acid; and a C12-C18 fatty acid salt. The fixing liquid is mixed with water serving as a dilution solvent.

According to a second aspect of the present invention, there is provided a fixing method for fixing resin-containing fine particles to a medium, including foaming the fixing liquid described above; forming a foamed fixing liquid having a desired film thickness on a contact application surface; and applying the foamed fixing liquid having the desired film thickness to the resin-containing fine particles on the medium.

According to a third aspect of the present invention, there is provided a fixing unit including a foamed fixing liquid generation unit that foams the fixing liquid described above to generate a foamed fixing liquid; a foamed fixing liquid application unit that applies the foamed fixing liquid to a resin-containing fine particles layer on a medium, the foamed fixing liquid application unit partially having a curved surface; and a film thickness controlling unit that controls a film thickness of the foamed fixing liquid on a surface of the foamed fixing liquid application unit.

According to a fourth aspect of the present invention, there is provided an image forming method including an image forming step of performing an electrostatic recording process with a developing agent including resin-containing fine particles containing resin and a coloring agent so as to form an unfixed toner image on a medium; and a fixing step of fixing the unfixed toner image to the medium with the fixing method described above.

According to a fifth aspect of the present invention, there is provided an image forming apparatus including an image forming unit that performs an electrostatic recording process with a developing agent including resin-containing fine particles containing resin and a coloring agent so as to form an unfixed toner image on a medium; and a fixing unit that fixes the unfixed toner image to the medium with the fixing unit described above.

BEST MODE FOR CARRYING OUT THE INVENTION

Figure 1A:
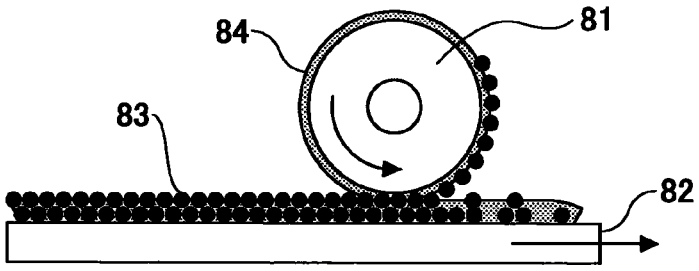
FIGS. 1A and 1B are schematic cross-sectional views showing an offset state caused in a conventional fixing unit.
Figure 1B:
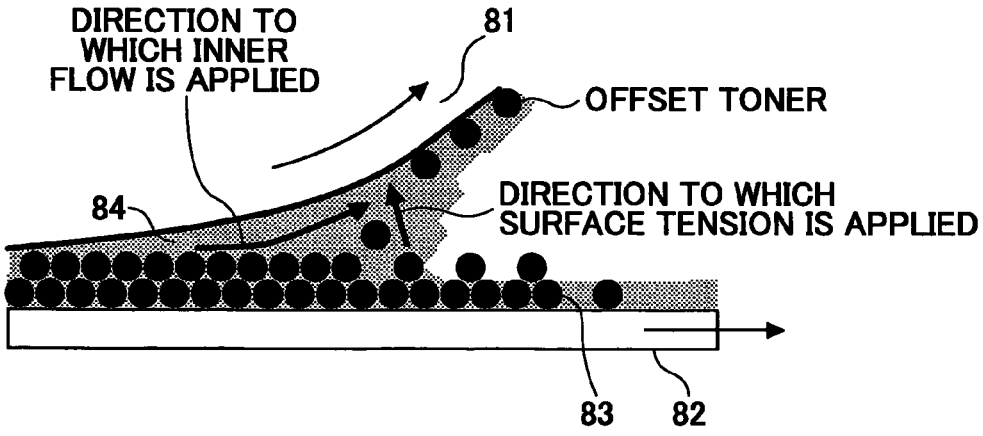
Figure 2:
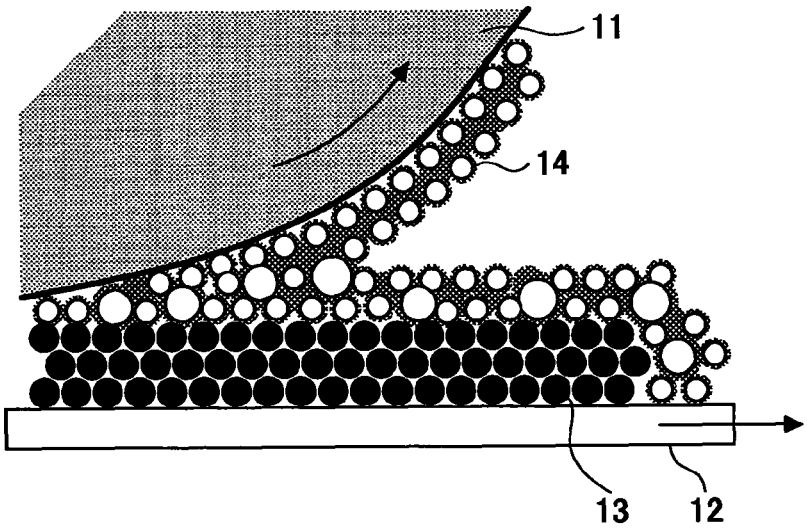
FIG. 2 is a schematic cross-sectional view showing fixed resin-containing fine particles after a fixing liquid is applied according to the principle of the present invention.
Figure 3:
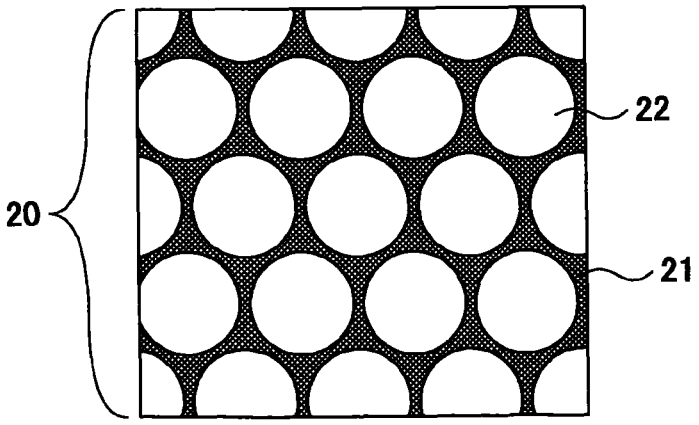
FIG. 3 is a schematic cross-sectional view showing the configuration of a foamed fixing liquid.

First, a description is made of the outline of the foamed fixing liquid described in Patent Document 4 and related to an embodiment of the present invention. As shown in FIG. 2, the foamed fixing liquid 14 having foam, which is formed by the foamed fixing liquid generation unit described below, is used as a fixing liquid, thus making it possible to reduce the powder density of the fixing liquid and increase the thickness of a fixing liquid layer on a coating roller 11. Moreover, an influence due to the surface tension of the fixing liquid is suppressed, thus making it possible to prevent the offset of resin-containing fine particles to the coating roller 11. In addition, when the size of the resin-containing fine particles is in the range of 5 μm through 10 μm, the diameters of the foam of the foamed fixing liquid 14 should be in the range of 5 μm through 50 μm so that the foamed fixing liquid 14 is applied to a resin-containing fine particles layer 13 without causing turbulence in the resin-containing fine particle layer 13 on a recording medium 12. Note that as shown in FIG. 3, a foamed fixing liquid 20 constituted of air foam 22 is formed by liquid film boundaries (hereinafter referred to as plateau boundaries) that partition the respective air foam 22.

Meanwhile, an anion system surfactant can provide high foaming property and foaming stability and is excellent as a foaming agent. Among anion system surfactants, a fatty acid salt provides the most excellent foaming stability and is best suited as the foaming agent for a fixing liquid. On the other hand, a softening agent has a strong defoaming effect. Therefore, as the concentration of the softening agent in the fixing liquid increases, the foaming property and the foaming stability of the fixing liquid are degraded. As a result, foam is hardly generated. In addition, since foam easily disappears, a foamed fixing liquid having low foam density cannot be obtained.

Therefore, in order to solve the degradation in the foaming property when the concentration of the softening agent in the fixing liquid is increased, various experiments were made in accordance with the types and concentrations of an anion system surfactant as factors. In addition, an experiment was made by focusing on the technique called "super fat" described in Non-Patent Document 1, i.e., free fatty acid contained in a solid washing agent (soap). Here, the outline of the technique called "super fat" is described. This is a method for adding a small amount of free fatty acid that is hardly oxidized so as to increase an excessive oil and fat content. According to this method, a small amount of unsaponified oil and fat is left, which in turn improves, for example, a moisturizing effect. According to Non-Patent Document 1, it is found that the foaming property is improved and the quality of foam becomes further creamy with the addition of a small amount of fatty acid to a soap aqueous liquid, which is called a super fat soap. Although a small amount of fatty acid was added to a fixing liquid having a softening agent as in the super fat so as to generate foam, both the foaming property and the foaming stability were poor.

On the other hand, as described below, the embodiment of the present invention uses a C12-C18 fatty acid salt as the foaming agent and contains C12-C18 fatty acid in the fixing liquid. As a result, it is found that a foamed fixing liquid whose foaming property would not be degraded even if the concentration of the softening agent increases can be provided. Here, the foamed fixing liquid according to the embodiment of the present invention is described in detail. Compared with a case in which water is simply foamed in the fixing liquid containing the softening agent, the C12-C18 fatty acid salt is excellent in the foaming property.

Specifically, a lauric acid salt (carbon number: 12), a myristic acid salt (carbon number: 14), a palmitic acid salt (carbon number: 16), and a stearic acid salt (carbon number: 18) are preferable. In addition, a pentadecylic acid (carbon number: 15), a margaric acid (carbon number: 17), etc., are preferable. On the other hand, the reactions of fatty acid and a softening agent are described. The softening agent and the fatty acid have an ester group and a carbonyl group, respectively, in their chemical structure. In this regard, the ester group in the softening agent and the carbonyl group in the fatty acid exhibit an electrical action in the system of the fixing liquid, which in turn causes a binding action between molecules and improves the foaming property and the foaming stability as the characteristics of the fixing liquid.

Furthermore, in the range of a C12-C18 fatty acid salt as well, the smaller the carbon number is, the poorer the foaming stability is although the foaming property is excellent. The larger the carbon number is, the more excellent the foaming stability is although the foaming property is poor. Therefore, it is more preferable to mix C12-C18 fatty acid salts together rather than using a single fatty acid salt in the fixing liquid. As a mixing ratio, it is preferable that the C14 myristic acid salt be included in the largest number and the C12 lauric acid salt and the C18 stearic acid salt be included in smaller number in the fixing liquid. As a more specific ratio of the fatty acid salt, it is preferable that the lauric acid salt, the myristic acid salt, the palmitic acid salt, and the stearic acid salt be mixed together in a weight ratio of, for example, 0:6:3:1, 1:5:3:1, and 1:4:4:1.

Meanwhile, the fixing liquid contains the fatty acid having the same carbon number as that of the fatty acid salt serving as the foaming agent. Therefore, even if the concentration of the softening agent increases, the foaming property and the foaming stability can be maintained. Where the concentration of the softening agent is less than 10% by weight, there is no problem in the foaming property even if the fixing liquid does not contain the fatty acid. On the other hand, where the concentration of the softening agent is 10% by weight or more, particularly, 30% by weight or more, foam is hardly generated only with the fatty acid salt, which in turn degrades the foaming property. However, when the fatty acid having the same carbon number as the fatty acid salt is contained in the fixing liquid having the softening agent whose concentration is 30% by weight, the foaming property can be maintained.

However, when the fatty acid is excessively contained in the fixing liquid, the ratio of the fatty acid salt serving as the foaming agent relatively decreases, which in turn degrades the foaming property. Accordingly, as described in the following specific example, it is preferable that the number of moles of the fatty acid salt be the same as or greater than that of the fatty acid. Alternatively, when the ratio of the fatty acid to the fatty acid salt is in the range from 5:5 through 1:9, the foaming property is excellent.

Note that in addition to the combination of the fatty acid and the fatty acid salt each having the same carbon number, the combination of myristic acid amine as the fatty acid salt and stearic acid as the fatty acid or the combination of palmitic acid potassium as the fatty acid salt and stearic acid as the fatty acid whose carbon number varies in the range of 12 through 18 may be used. In short, the C12-C18 fatty acid is contained in the fixing liquid. As a result, even if the fixing liquid contains a high-concentration softening agent, the foaming property is not degraded. Therefore, it is possible to generate foam having the excellent foaming stability and extremely low density.

Furthermore, it is found that even the fixing liquid containing the C12-C18 fatty acid using other anion system surfactants, e.g., alkyl ether sulfate (AES) as the foaming agent, prevents the foaming property from being degraded due to the increase in the concentration of the softening agent. However, the combination of the fatty acid salt and the fatty acid is the most preferable.

Moreover, as the fatty acid salt, fatty acid sodium, fatty acid potassium, and fatty acid amine are preferable. As a specific method for manufacturing the most preferable fatty acid amine, water is first heated, and then fatty acid is added to the heated water. Subsequently, triethanol amine is added to the mixture. The mixture is stirred and heated for a certain period of time and subjected to saponification reaction. Thus, the fatty acid amine can be manufactured. At this time, the molar ratio of the fatty acid to the triethanol amine is set to be in the range of 1:0.5 through 1:0.9 so that the ratio of the fatty acid becomes greater. As a result, unreacted fatty acid is left after the saponification reaction. Accordingly, the fatty acid and the fatty acid amine can be mixed together in the fixing liquid. The same applies to a case where a sodium salt and a potassium salt are used.

Meanwhile, when the concentration of the softening agent in the fixing liquid increases, the softening agent is not likely to dissolve in water serving as a dilution solvent. After making various studies, it is found that when polyhydric alcohols, specifically, ethylene glycol, diethylene glycol, propylene glycol, 1,3 butylene glycol, and glycerine are contained in the fixing liquid, the softening agent is dissolved even in high concentration, and the foaming property of the fatty acid salt is not degraded but rather improved. Furthermore, it is preferable that the content of the polyhydric alcohols be in the range of 1% by weight through 30% by weight. 30% by weight or more of the content of the polyhydric alcohols is not preferable because the foaming property is rather degraded.

Next, as described below, the thickness of a foamed fixing liquid layer on the surface of a fixing liquid application unit is controlled in accordance with the thickness of a resin-containing fine particles layer relative to an entire medium surface on which the fixing liquid according to the embodiment of the present invention is foamed. However, when the foamed fixing liquid layer having the same thickness is applied to the entire medium surface in a state where the resin-containing fine particles are toner and both color images and black and white characters exist on the medium, partial defects occur. Specifically, a fixing failure and the disappearance of an image are caused in the thick toner layer of a color photographic image, or pieces of printing matters are stuck to each other because the parts of the black and white characters become sticky. Reasons for the defects are described in detail below.

Generally, by being simply stirred, a large foam in the range of 0.5 mm through 1.0 mm can be comparatively easily generated in a few minutes (0.1 second) or faster. Here, paying attention to a fact in which a visually-observable foam with a diameter greater than a desired foam diameter can be easily and quickly generated, a method for generating minute foam in the range of 5 μm through 50 μm from a large foam is keenly studied. As a result, when a shearing force is applied to the large foam so as to be divided, desired minute foam can be quickly generated compared with the method in which minute foam is generated in the liquid state described above.

Figure 4:
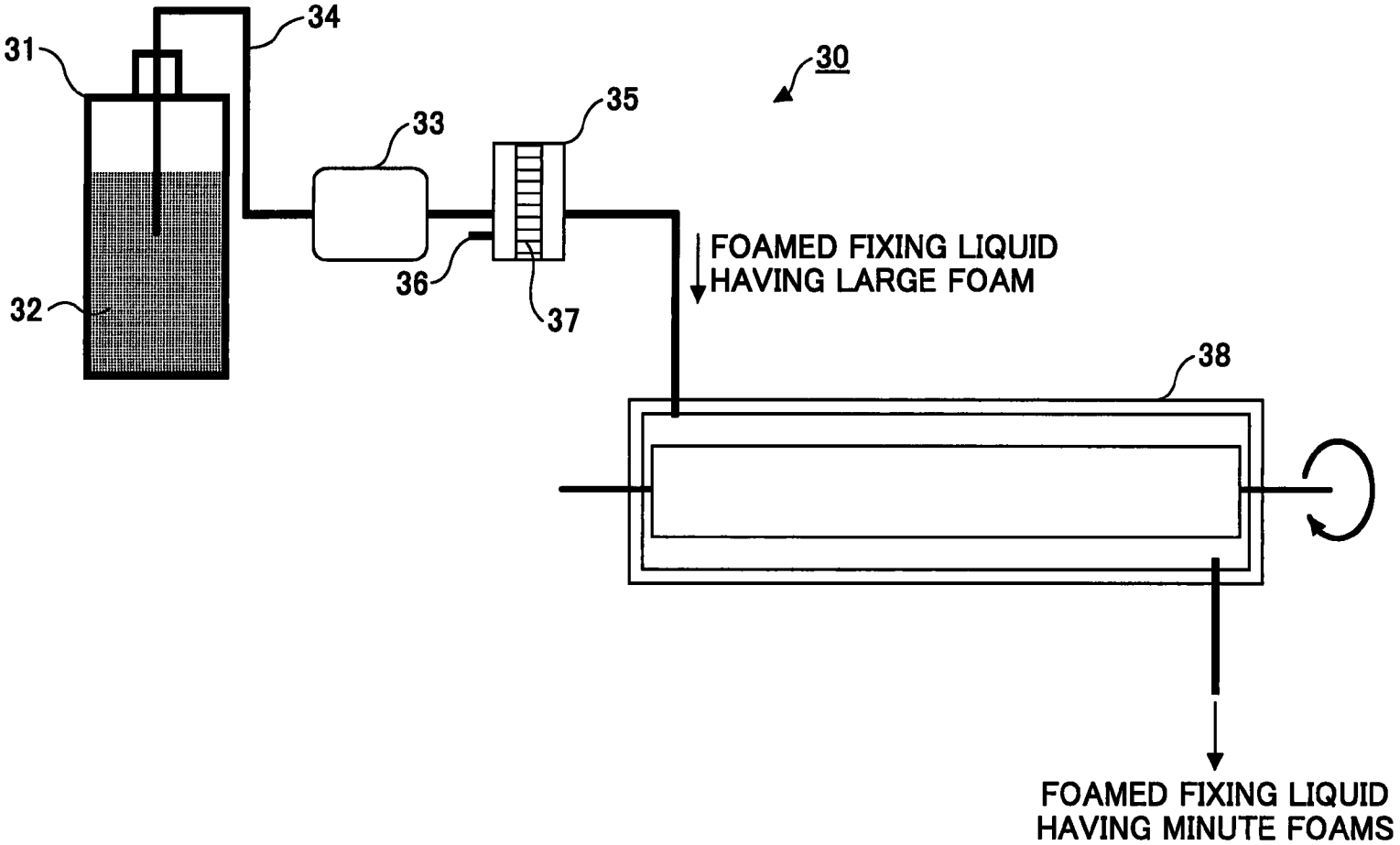
FIG. 4 is a schematic diagram showing the configuration of a foamed fixing liquid generation unit in a fixing unit according to the embodiment of the present invention.

As described in FIG. 4, in the large foam generation unit of the foamed fixing liquid generation unit 30 that generates a large foam and divides it into minute foam, the aquiform fixing liquid 32 in a fixing liquid container 31 according to the embodiment of the present invention described above is supplied to a gas and liquid mixing unit 35 with liquid transportation units such as a conveyance pump 33 and a liquid conveyance pipe 34. The gas and liquid mixing unit 35 has an air hole. As a liquid flows, negative pressure is caused in the air hole 36. Then, gas is introduced into the gas and liquid mixing unit 35 through the air hole 36 to mix the liquid with the gas and passes through a minute hole sheet 37, thereby generating a large foam having a uniform diameter. It is preferable that the hole diameter of the minute hole sheet 37 be in the range of 30 μm through 100 μm. Without being limited to the minute hole sheet 37, a porous member having a continuous foam structure may be used. Examples of the porous member include a sintered ceramic plate, an unwoven fabric, and a foamed resin sheet, each having a hole diameter in the range of 30 μm through 100 μm. In addition to the above method, a large foam is preferably generated in such a manner that the aquiform fixing liquid 92 supplied from the conveyance pump 33 and the gas from the air hole 36 are stirred with a blade-like stirring bar so as to get air foam involved in the aquiform fixing liquid 92, or the aquiform fixing liquid 92 supplied from the conveyance pump 33 is subjected to bubbling with an air supply pump, etc.

Then, as shown in FIG. 4, in order to divide a large foam into two or more minute foams, a minute foam generation unit 38 is provided in the foamed fixing liquid generation unit 30 to apply a shearing force to the large foam. The minute foam generation unit 38 is of a closed double cylinder structure in which an inner cylinder is rotatable. In this structure, the foamed fixing liquid is supplied from a part of an outer cylinder and subjected to the shearing force with the rotating inner cylinder while passing through a gap (serving as a flow path) between the rotating inner cylinder and the outer cylinder. After being subjected to the shearing force, the large foam is divided into minute foams. Thus, the foamed fixing liquid composed of minute foams each having a desired diameter can be obtained from the foam port provided at the outer cylinder. Furthermore, in order to improve a liquid conveyance ability in the cylinder, spiral grooves may be provided in the inner cylinder.

As described above, the foamed fixing liquid generation unit 30 has both the large foam generation unit that converts the aquiform fixing liquid 92 into the liquid having the foam with a large diameter and the minute foam generation unit that applies the shearing force to the large foam to generate minute foams. Therefore, the aquiform fixing liquid 92 can be converted into the foamed fixing liquid having the minute foams with a diameter in the range of 5 μm through 50 μm in a short period of time.

Next, a description is made of the fixing liquid application unit of the fixing unit.

Figure 5A:
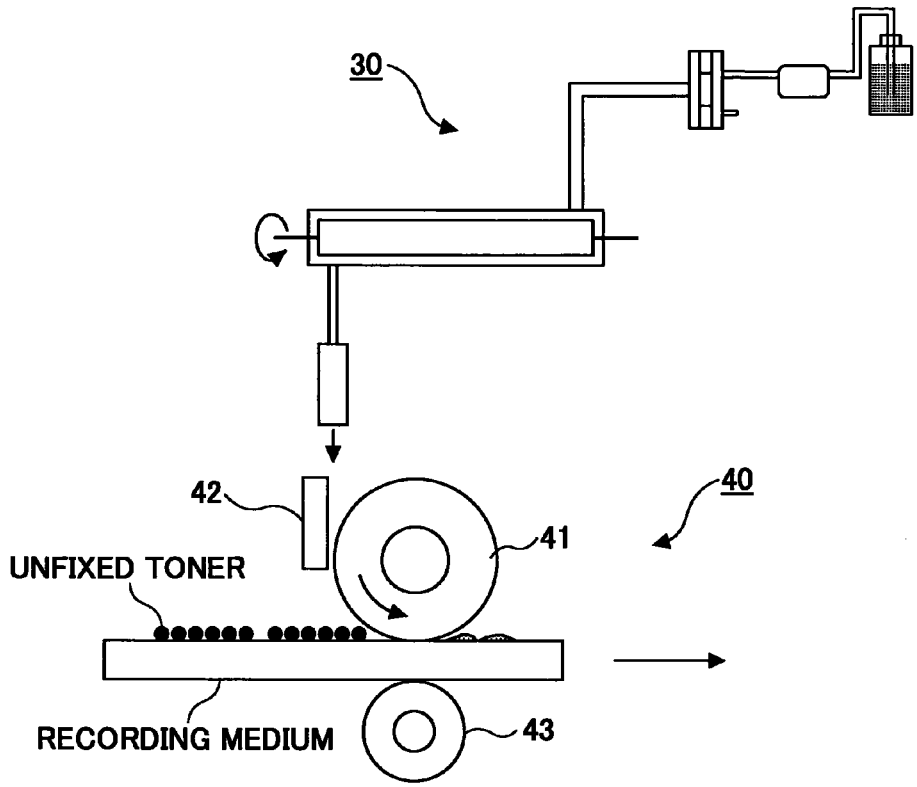
FIG. 5 is a schematic configuration diagram showing an example of a fixing liquid application unit in the fixing unit according to the embodiment of the present invention.
Figure 5B:
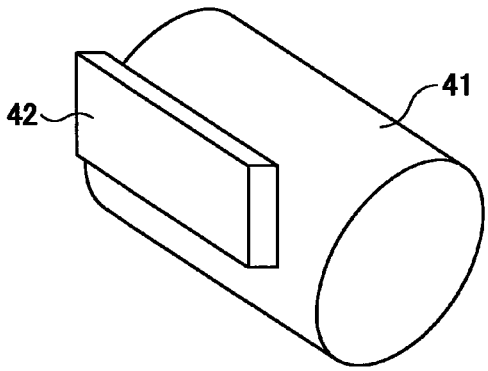

FIGS. 5A and 5B are schematic configuration diagrams showing an example of the fixing liquid application unit according to the embodiment of the present invention. Here, resin-containing fine particles are toner particles. The fixing unit 40 according to the embodiment of the present invention shown in FIG. 5A has a coating roller 4, a film thickness controlling blade 42, and a pressurizing roller 43. The controller 42 applies the foamed fixing liquid having desired minute foams generated by the foamed fixing liquid generation unit 30 to a resin-containing fine particles layer (toner particles layer). The film thickness controlling blade 42 of the unit that controls the optimum film thickness of the foamed fixing liquid that controls the film thickness of the foamed fixing liquid having desired minute foams on the surface of the coating roller 41 in accordance with the thickness of an unfixed toner particles layer on a recording medium so as to obtain the optimum film thickness of the foamed fixing liquid. The pressurizing roller 43 is provided opposite to the coating roller 41. As shown in FIG. 5B, the layer of the foamed fixing liquid is formed on the coating roller 41 through the film thickness controlling blade 42 in accordance with the thickness of the unfixed toner particles layer on the recording medium. With the film thickness controlling blade 42, it is possible to control the size of air foams of the foamed fixing liquid, the foam viscosity thereof, the application pressurizing force thereof, and provide the most appropriate film thickness of the fixing liquid layer relative to the time required until the foamed fixing liquid penetrates into the unfixed toner particles layer in accordance with the thickness of the unfixed toner particles layer. The foamed fixing liquid having desired minute foams is generated by the foamed fixing liquid generation unit 30 composed of the large foam generation unit that forms a large foam and the minute foam generation unit that divides the large foam into minute foams with the shearing force. Then, the foamed fixing liquid is dropped between the coating roller 41 and the film thickness controlling blade 42.

Note that the powder density of the foamed fixing liquid is preferably in the range of 0.01 g/cm$^3$ through 0.1 g/cm$^3$. In order to prevent a residual liquid feeling on a medium surface at the time of applying the fixing liquid, the powder density of foams is preferably in the range of 0.01 g/cm$^3$ through 0.02 g/cm$^3$, particularly preferably in the range of 0.02 g/cm$^3$ or smaller. This is because the thickness of the foam film of the fixing liquid on the surface of the contact application unit must be greater than or equal to the thickness of the fine particles layer on the medium (so that the gap between the fine particles layers is filled with the foamed fixing liquid). Therefore, the thickness of the foam film is preferably in the range of 50 μm through 80 μm. On the other hand, in order to prevent the residual liquid feeling (wet feeling) due to the adhesion of the fixing liquid onto the medium surface, the adhesion amount of the fixing liquid is preferably 0.1 mg/cm$^2$ or smaller. For this reason, the density of foams must be in the range of 0.125 g/cm$^3$ through 0.02 g/cm$^3$, at least 0.02 g/cm$^3$ or smaller.

Moreover, the fixing liquid is required to be foamed only when being applied to the resin-containing fine particles layer such as toner on a recording medium such as a sheet. Therefore, the fixing liquid is not necessarily in the form of foams in a storage container. Instead, it is preferable to provide a unit that foams the liquid either at the time of supplying the liquid from the container or in a liquid conveyance path through which the fixing liquid is applied to the resin-containing fine particles layer. In short, the aquiform fixing liquid is contained in the storage container and foamed after being taken out from the container. With this configuration, the size of the container can be reduced.

Figure 6B:
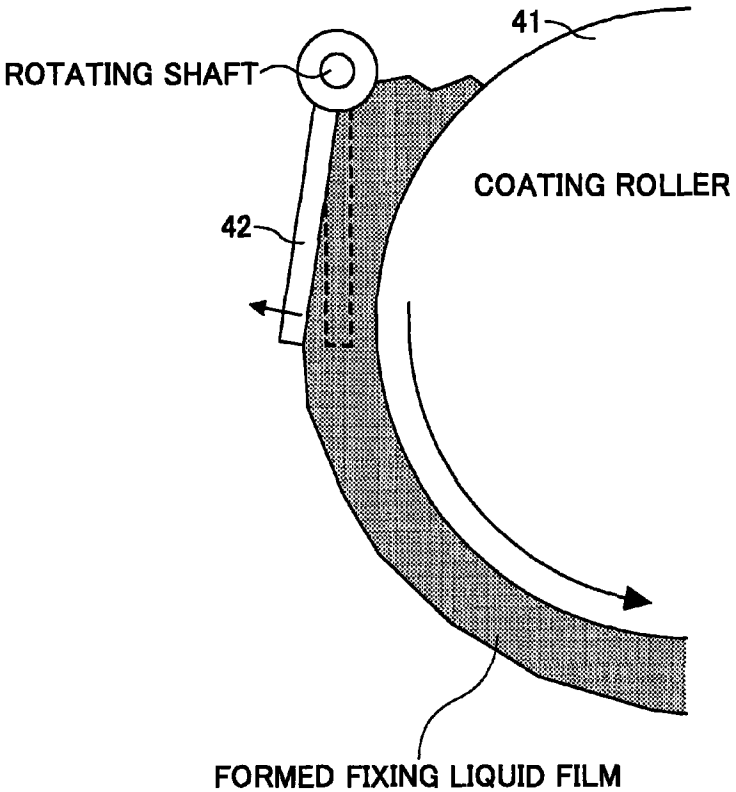
FIGS. 6A and 6B are schematic diagrams showing states when the film thickness of the foamed fixing liquid is controlled on a coating roller using a film thickness controlling blade.
Figure 6A:
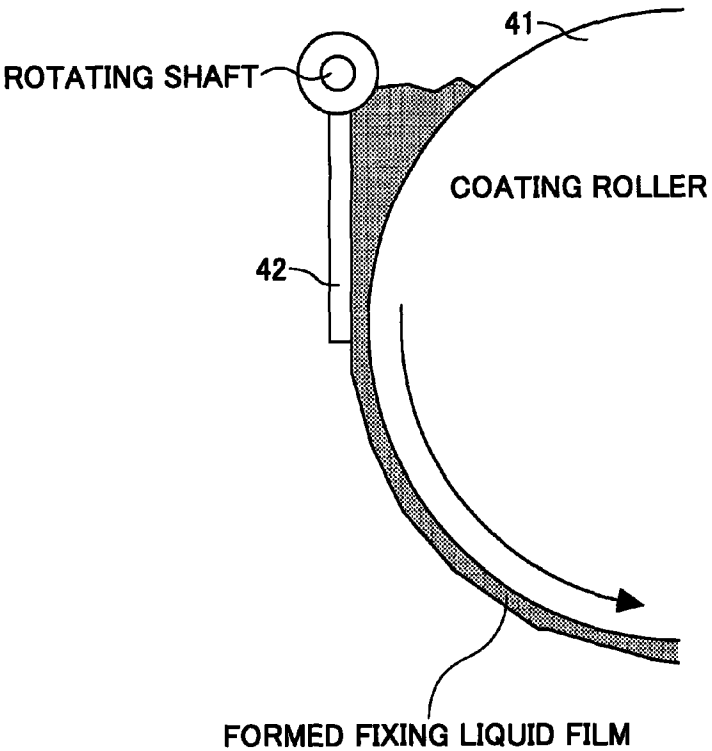

As shown in FIGS. 6A and 6B, the film thickness controlling blade 42 having a gap between the film thickness controlling blade 42 and the coating roller 41 is used for controlling the film thickness of the foamed fixing liquid on the coating roller 41. The gap is narrowed to reduce the film thickness as shown in FIG. 6A, while it is widened to increase the film thickness as shown in FIG. 6B. The film thickness controlling blade 42 has a rotating shaft at its end to control the gap. Accordingly, it is possible to control the thickness of the toner layer, environmental temperature, the size of air foam of the foamed fixing liquid, the foam viscosity thereof, the application pressurizing force thereof, and the most appropriate film thickness for adjusting the time required until the foamed fixing liquid penetrates into the unfixed toner particles layer in accordance with the layer thickness of the unfixed toner particles.

As the unit that conveys the aquiform fixing liquid from the fixing liquid container 31 to the mechanism where the fixing liquid is foamed, the conveyance pump 33 is used as shown in FIG. 4. Examples of the conveyance pump 33 include a gear pump, a bellows pump, a tube pump, etc. Among them, the tube pump is the most appropriate. Since the gear pump has a vibration mechanism and a rotation mechanism, the fixing liquid is foamed in the pump. As a result, pressure may be affected in the fixing liquid which degrades the conveyance ability. In addition, the components of the gear pump may contaminate the fixing liquid, or conversely the fixing liquid may contaminate the components. On the other hand, the tube pump is configured to extrude the fixing liquid from a tube while deforming the tube. Therefore, only the tube comes into contact with the fixing liquid. If the tube pump is made of a member having a liquid-resistance property against the fixing liquid, it is possible to prevent the contamination of the fixing liquid and degrade the components of the pump. Moreover, since the tube of the tube pump is just deformed when the fixing liquid is extruded, the fixing liquid is not foamed. As a result, it is possible to prevent the reduction of the conveyance ability.

Instead of the film thickness controlling blade 42 shown in FIGS. 6A and 6B, a wire bar is used for controlling the thickness of the foamed fixing liquid on the coating roller 41. As described above, the foamed fixing liquid is generated by the foamed fixing liquid generation unit composed of the large foam generation unit that generates a large foam and the minute foam generation unit that divides the large foam into minute foam with the shearing force. The foamed fixing liquid is deposited between the wire bar and the coating roller 41 from a liquid supplying port. When the wire bar is used as a film controlling unit instead of the film thickness controlling blade 42, the film uniformity of the foamed fixing liquid in a shaft direction on the surface of the coating roller 41 is further improved.

Figure 7:
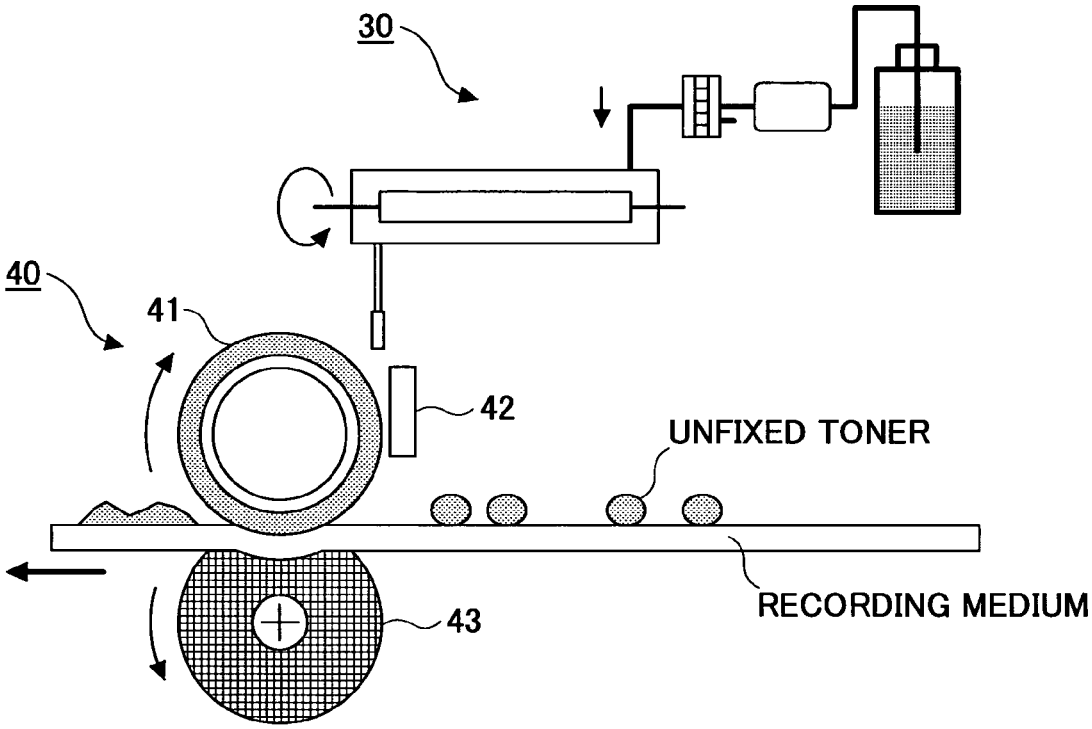
FIG. 7 is a schematic configuration diagram showing a configuration of the fixing unit according to the embodiment of the present invention.

FIG. 7 is a schematic configuration diagram showing the configuration of the fixing unit according to the embodiment of the present invention. In the fixing unit 40 according to this embodiment shown in FIG. 7, a pressurizing roller 43 has a resilient layer made of a sponge material. Here, it is necessary to take the timing of nip time to separate the coating roller 41 from the resin-containing fine particles layer after the foamed fixing liquid penetrates into the resin-containing fine particles layer such as toner and reaches a medium such as sheet. Therefore, the sponge material capable of being greatly deformed by a small pressurizing force is used for ensuring the nip time in the range of 50 through 300 milliseconds.

Note that the nip time is calculated by dividing a nip width by a sheet conveyance speed. The sheet conveyance speed can be found by the design data of a sheet conveyance and driving mechanism. The nip time can be found as follows. That is, a colored dye that does not dehydrate is first put on the entire surface of the coating roller 41 in small amounts. Then, a recording medium is sandwiched between the coating roller 41 and the pressurizing roller 43 opposite to the coating roller 41 so as to be pressurized (while the roller is not rotated). Thus, the colored dye is caused to adhere onto the recording medium. The length in the sheet conveyance direction of a coloring part (normally a rectangular coloring part) is measured as the nip width.

It is necessary to make the nip time the same as or longer than or equal to the penetration time of the foamed fixing liquid into the toner layer by adjusting the nip width in accordance with the conveyance speed of a recording medium. In the example shown in FIG. 7, the pressurizing roller 43 is made of a resilient porous material (hereinafter referred to as a sponge material) as the resilient layer. Therefore, a distance between the shaft of the coating roller 41 and that of the pressurizing roller 43 is changed in accordance with the conveyance speed of the recording medium, thereby making it easier to change the nip width. The pressurizing roller 43 may be made of a resilient rubber instead of the sponge material. However, the sponge can be deformed by a force lighter than the force with which the resilient rubber is deformed. Therefore, it is possible to ensure a long nip width without excessively increasing the pressurizing force of the coating roller 41.

Note that the fixing liquid contains a resin softening or swelling agent. In an event that the fixing liquid adheres onto the pressurizing roller 43 made of the sponge material, the sponge is likely to be, for example, softened. Therefore, the resin material of the sponge material is preferably one free from softening and swelling against the softening or swelling agent. In addition, the pressuring roller 43 made of the sponge material may be covered with a flexible film. Accordingly, even if the sponge material is a material that is degraded by the softening or swelling agent, it is possible to prevent the degradation of the pressurizing roller 43 by covering the sponge material with the flexible film. As the sponge material, resin porous materials such as polyethylene, polypropylene, and polyamide are preferable. Furthermore, as the flexible film that covers the sponge material, polyethylene terephthalate, polyethylene, polypropylene, and tetrafluoroethylene/fluoroalkyl vinyl ether copolymer (PFA) are preferable.

In FIG. 7, in a case where the coating roller 41 comes into contact with the pressurizing roller 43 made of the sponge material at all times, the foamed fixing liquid may adhere onto and contaminate the pressurizing roller 43 when the recording medium is not conveyed. In order to solve this problem, a sheet tip-end detection unit (not shown) is provided ahead of the position where the recording medium is conveyed. In response to a tip-end detection signal, the foamed fixing liquid is preferably applied to the coating roller 41 at the timing at which the foamed fixing liquid is applied only from the tip end of the recording medium.

Furthermore, in FIG. 7, the coating roller 41 is separated from the pressurizing roller 43 during a standby state. It is preferable that the coating roller 41 come into contact with the pressurizing roller 43 only at the time of applying the fixing liquid in accordance with a tip-end detection signal for the recording medium with a driving mechanism not shown. Moreover, it is preferable that the coating roller 41 be separated from the pressurizing roller 43 in accordance with a rear-end detection signal for the recording medium.

Figure 8:
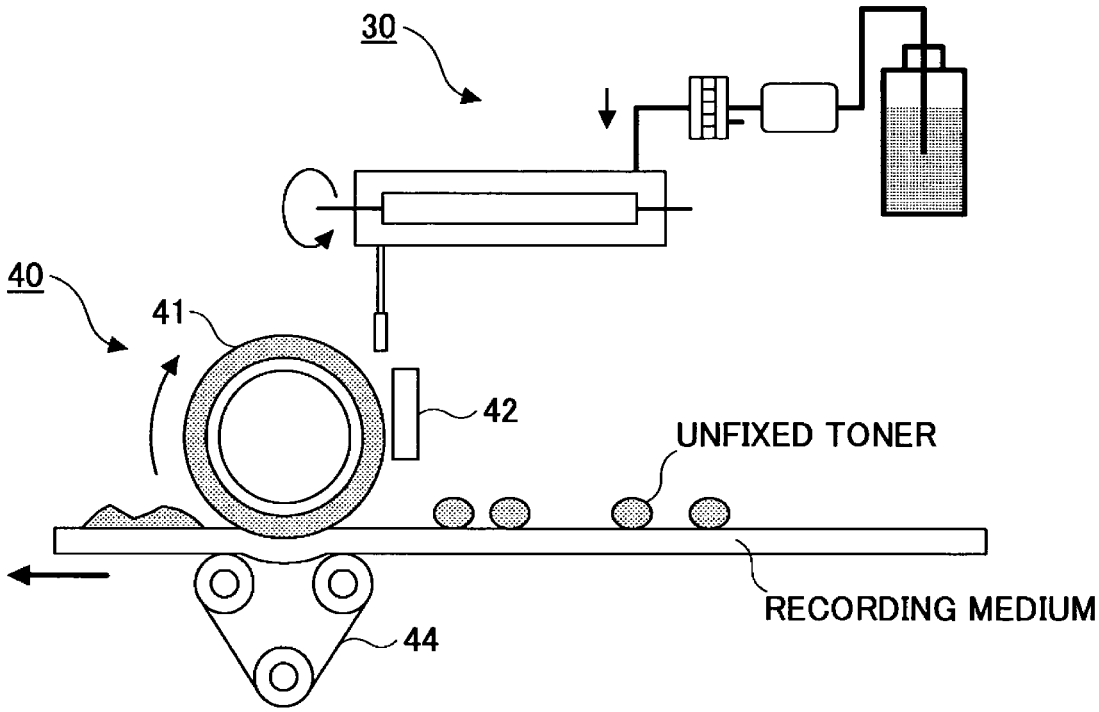
FIG. 8 is a schematic configuration diagram showing another configuration of the fixing unit according to the embodiment of the present invention.

FIG. 8 is a schematic configuration diagram showing another configuration of the fixing unit 40 according to the embodiment of the present invention. The fixing unit 40 according to the embodiment shown in FIG. 8 uses a pressurizing belt 44 instead of the pressurizing roller 43 shown in FIG. 7. The foamed fixing liquid is generated by the foamed fixing liquid generation unit 30 composed of the large foam generation unit that generates a large foam and the minute foam generation unit that divides the large foam into minute foam with the shearing force. Then, the foamed fixing liquid with a desired foam diameter is supplied from a liquid supplying port to the supplying port of the film thickness controlling blade 42 through a tube, etc. The gap between the film thickness controlling blade 42 and the coating roller 41 is adjusted to control the layer film thickness of the foamed fixing liquid on the coating roller 41. Thus, the most appropriate film thickness of the foamed fixing liquid is obtained. Note that as the pressurizing belt 44, a member obtained by coating a releasable fluororesin as represented by PFA on a base substrate such as a seamless nickel belt and a seamless PET film is used.

When the belt is used in the fixing unit 40 as described above, the nip width can be easily increased. Accordingly, without being limited to the configuration shown in FIG. 8, it is preferable that the fixing unit use a belt as the coating roller and a roller as the pressurizing unit. Furthermore, when any of the coating roller and the pressuring unit is configured by the belt, the nip width can be easily increased. Moreover, the conveyance speed of a sheet can be accelerated provided that the nip time is the same, without applying an excessive force causing a wrinkle to the sheet. As a result, the fixing liquid can be applied at high speed.

Note that an unsaturated fatty acid salt may be used in the fixing liquid, and a C18 unsaturated fatty acid containing 1-3 double bonds is preferable. Specifically, an oleic acid, a linoleic acid, and a linolenic acid are suitable. Since an unsaturated fatty acid containing 4 or more double bonds has strong reactivity, the shelf stability of the fixing liquid becomes poor. The unsaturated fatty acid salt with these unsaturated fatty acids is used singly or in combination as a foaming agent. Furthermore, the saturated fatty acid salt and the unsaturated fatty acid salt may be mixed together and used as the foaming agent.

Furthermore, the softening agent, which dissolves or swells resin to be softened, contains aliphatic ester. The aliphatic ester is excellent in solubility or swelling property for dissolving or swelling a part of the resin included in toner, etc.

Moreover, from the viewpoint of safety to the human body, the acute oral toxicity (LD50) of the softening agent is preferably 3 g/kg or greater and more preferably 5 g/kg. As generally used as a cosmetic material, the aliphatic ester has high safety for the human body.

Furthermore, toner is fixed to a recording medium in frequently-used equipment under a hermetically-sealed environment, and the softening agent remains in the toner after the toner is fixed to the recording medium. Therefore, it is preferable that volatile organic compounds (VOC) and unpleasant odors be not generated when the toner is fixed to the recording medium. In other words, the softening agent preferably does not contain a substance responsible for the volatile organic compounds and unpleasant odors. Compared with generally-used organic solvents (such as toluene, xylene, methylethyl ketone, and ethyl acetate), the aliphatic ester has a high boiling point and low volatility and does not generate pungent odors.

Note that as a practical yardstick for measuring odors in an office, etc., at high accuracy, an odor index (10×log (dilution magnifying power of a substance until the odors of the substance are not perceived)) using a three-point comparison type smell bag method as an organoleptic measurement method can be used as an index for odors. Furthermore, the odor index of the aliphatic ester contained in the softening agent is preferably 10 or smaller. In this case, unpleasant odors are not perceived in an ordinary office environment. Moreover, in addition to the softening agent, other liquid agents contained in the fixing liquid do not preferably generate unpleasant odors and pungent odors.

In the fixing liquid according to the embodiment of the present invention, the aliphatic ester preferably contains saturated aliphatic ester. When the fatty acid ester contains the saturated aliphatic ester, the preservation stability (resistance to oxidation, hydrolytic cleavage, etc.) of the softening agent can be improved. In addition, the saturated aliphatic ester has high safety for the human body, and it can generally dissolve or swell the resin contained in toner within a minute. Moreover, the saturated aliphatic ester can reduce the adhesiveness of the toner provided onto a recording medium. This is because the saturated aliphatic ester forms an oily film on the surface of the dissolved or swelled toner.

Accordingly, in the fixing liquid according to the embodiment of the present invention, the general formula of the saturated aliphatic ester preferably contains the compound represented by R1COOR2 wherein R1 is a C11-C14 alkyl group and R2 is a C1-C6 linear or branched alkyl group. When the number of carbons of R1 and R2 is smaller than a desired number, odors are generated. When the number of the carbons of R1 and R2 is larger than the desired number, a resin softening ability is reduced.

In other words, when the saturated aliphatic ester contains the compound represented by the general formula R1COOR2 wherein R1 is a C11-C14 alkyl group and R2 is a C1-C6 linear or branched alkyl group, the solubility and the swelling property with respect to the resin contained in the toner can be improved. Furthermore, the odor index of the compound is 10 or smaller, and the compound does not generate unpleasant odors and pungent odors.

Examples of aliphatic monocarboxylic acid ester as the compound include lauric acid ethyl, lauric acid hexyl, tridecyl acid ethyl, tridecyl acid isopropyl, myristic acid ethyl, and myristic acid isopropyl. Most of the aliphatic monocarboxylic acid esters are dissolved in an oily solvent but not in water. Accordingly, most of the aliphatic monocarboxylic acid esters of the fixing liquid contain glycol as a dissolution auxiliary agent in an aqueous solvent and are in a dissolution or microemulsion state.

Furthermore, in the fixing liquid according to the embodiment of the present invention, the aliphatic ester preferably contains an aliphatic dicarboxylic acid ester. When the aliphatic ester contains the aliphatic dicarboxylic acid ester, the resin contained in toner can be dissolved or swelled in a shorter period of time. For example, in the case of high-speed printing of about 60 ppm, the time required until unfixed toner particles to which the fixing liquid is applied are fixed to a recording medium is preferably within a minute. When the aliphatic ester contains the aliphatic dicarboxylic acid ester, the time required until the unfixed toner particles to which the fixing liquid is applied are fixed to the recording medium can be within 0.1 minute. Moreover, the resin contained in the toner can be dissolved or swelled with the addition of lesser amounts of the softening agent. Therefore, the content of the softening agent contained in the fixing liquid can be reduced.

Accordingly, in the fixing liquid according to the embodiment of the present invention, the general formula of the aliphatic dicarboxylic acid ester contains the compound represented by $R3(COOR4)_2$ wherein. R3 is a C3-C8 alkylene group and R4 is a C3-C5 linear or branched alkyl group. When the number of the carbons of R3 and R4 is smaller than a desired number, odors are generated. When the number of the carbons of R3 and R4 is larger than the desired number, the resin softening ability is reduced.

In other words, when the aliphatic dicarboxylic acid ester contains the compound represented by the general formula $R3(COOR4)_2$ wherein R3 is a C3-C8 alkylene group and R4 is a C3-C5 linear or branched alkyl group, the solubility and the swelling property with respect to the resin contained in the toner can be improved. Furthermore, the odor index of the compound is 10 or smaller, and the compound does not generate unpleasant odors and pungent odors.

Examples of an aliphatic dicarboxylic acid ester as the compound include succinic acid-2-ethylhexyl, dibutyl adipate, di-isobutyl adipate, di-isopropyl adipate, di-isodecyl adipate, diethyl sebacate, and dibuthyl sebacate. Most of the aliphatic dicarboxylic acid esters are dissolved in an oily solvent but not in water. Accordingly, most of the aliphatic dicarboxylic acid esters of the fixing liquid contain glycol as a dissolution auxiliary agent in an aqueous solvent and are in a dissolution or microemulsion state.

Moreover, in the fixing liquid according to the embodiment of the present invention, the aliphatic ester preferably contains aliphatic dicarboxylic acid dialkoxylalkyl. When the aliphatic ester contains the aliphatic dicarboxylic acid dialkoxylalkyl, the fixing property of toner with respect to a recording medium can be improved.

In the fixing liquid according to the embodiment of the present invention, the general formula of the aliphatic dicarboxylic acid dialkoxyalkyl contains the compound represented by $R5(COOR6\text{-}O\text{-}R7)_2$ wherein R5 is a C2-C8 alkylene group, R6 is a C2-C4 alkylne group, and R7 is a C1-C4 alkyl group. When the number of the carbons of R5 and R6 is smaller than a desired number, odors are generated. When the number of the carbons of R5 and R6 is larger than the desired number, the resin softening ability is reduced.

In other words, when the aliphatic dicarboxylic acid dialkoxylalkyl contains the compound represented by the general formula $R5(COOR6\text{-}O\text{-}R7)_2$ wherein R5 is a C2-C8 alkylene group, R6 is a C2-C4 alkylene group, and R7 is a C1-C4 alkyl group, the solubility or the swelling property with respect to the resin contained in the toner can be improved. Furthermore, the odor index of the compound is 10 or smaller, and the compound does not generate unpleasant odors and pungent odors.

Examples of aliphatic dicarboxylic dialkoxylalkyl as the compound include succinic acid diethoxyethyl, succinic acid dibutoxyethyl, diethoxyethyl adipate, dibuthoxyethyl adipate, and sebacic acid dietoxyethyl. Most of the aliphatic dicarboxylic acid alkoxylalkyl of the fixing liquid contain glycol as a dissolution auxiliary agent in an aqueous solvent and are in a dissolution or microemulsion state.

Furthermore, a citrate ester, ethyl carbonate, and propylene carbonate are also suitable as the softening or swelling agent instead of the aliphatic ester.

Meanwhile, if foams disappear when the foamed fixing liquid is pressed and penetrated into the fine particles layer of the toner at an application contact nip part, penetration inhibition is caused. For this reason, foams having excellent foaming stability are demanded. Therefore, the fixing liquid preferably contains a 1:1 type aliphatic alkanolamide. Although the 1:1 type aliphatic alkanolamide and a 1:2 aliphatic alkanolamide are available, the 1:1 type aliphatic alkanolamide is suitable as the foaming stability according to the embodiment of the present invention.

Note that the resin-containing fine particles to be fixed are not limited to the toner, but any fine particles may be used so long as they contain resin. For example, resin-containing fine particles containing a conductive member may be used. Furthermore, the recording medium is not limited to a recording sheet, but any of metal, resin, ceramic, etc., may be used. However, the recording medium is preferably permeable to the fixing liquid. If the substrate of the recording medium does not have the liquid permeability, the recording medium preferably has a liquid permeable layer on the substrate. The shape of the recording medium is not limited to a sheet, but the recording medium may be a three-dimensional object having a plane surface and a curved surface. For example, the embodiment of the present invention can also be applied to so-called varnish coating in which transparent resin-containing fine particles are uniformly fixed to a medium such as a sheet to protect the surface of the sheet.

Among the resin-containing fine particles, the toner used for an electrophotographic process shows the greatest fixing effect as a combination with the fixing liquid according to the embodiment of the present invention. The toner contains a coloring agent, a charge controlling agent, and resin such as binder resin and a release agent. The resin contained in the toner is not particularly limited. However, examples of the preferred binder resin include a polystyrene resin, a styrene-acrylic copolymer resin, and a polyester resin, and examples of the release agent include wax components such as a carbana wax and polyethylene. In addition to the binder agent, the toner may contain a general coloring agent, a charge controlling agent, a fluidity imparting agent, an external additive, etc. Furthermore, the toner is preferably subjected to water-repellent treatment in such a manner that hydrophobic fine particles having a methyl group such as hydrophobic silica and hydrophobic oxidized titanium are fixed to the surface of toner particles. The recording medium is not particularly limited, but it includes a sheet, fabric, and a plastic film such as an OHP sheet having the liquid permeable layer. According to the embodiment of the present invention, the oiliness represents the property in which water solubility at 20° C. room temperature is 0.1% by weight or lower.

Furthermore, the foamed fixing liquid preferably has a sufficient affinity for the toner particles subjected to the water-repellent treatment. Here, the affinity represents the degree of the extended wettablility of a liquid with respect to the surface of a solid matter when the liquid comes into contact with the solid matter. In other words, the foamed fixing liquid preferably shows sufficient wettablility with respect to the toner subjected to the water-repellent treatment. The surface of the toner, which is subjected to the water-repellent treatment with hydrophobic fine particles such as hydrophobic silica and hydrophobic oxidized titanium, is covered with a methyl group existing on the surface of the hydrophobic silica and the hydrophobic oxidized titanium and has a surface energy of about 20 mN/m. Actually, since the entire surface of the toner, which is subjected to the water-repellent treatment, is not completely covered with the hydrophobic fine particles, it is presumed that the surface energy of the toner is in the range of about 20 through 30 mN/m. Therefore, in order for the foamed fixing liquid to have the sufficient affinity (sufficient wettablility) for the water-repellent toner, the surface tension of the foamed fixing liquid is preferably in the range of 20 through 30 mN/m.

When an aqueous solvent is used, a surfactant is preferably added to the aqueous solvent so that the surface tension of the foamed fixing liquid is in the range of 20 through 30 mN/m. In addition, the aqueous solvent preferably contains a polyhydric alcohol. With these materials, the stability of air foam in the foamed fixing liquid is increased and the air foam hardly disappears. For example, a monohydric alcohol such as cetanol and polyhydric alcohols such as glycerine, propylene glycol, 1,3 buthylene glycol are preferable. When the foamed fixing liquid contains the monohydric or polyhydric alcohol, the curling of a medium such as a sheet can be effectively prevented.

Furthermore, the fixing liquid preferably contains an oily component for improving the permeablility and preventing the curling of a medium such as a sheet to form an O/W emulsion and a W/O emulsion. In this case, as specific dispersing agents, sorbitan fatty acid esters such as sorbitan monooleate, sorbitan monostearate, and sorbitan sesquioleate and sucrose esters such as a sucrose laurate ester and a sucrose stearic acid ester are preferable.

Note that examples of a method for dissolving or microemulsion-dispersing the softening agent in the fixing liquid include a mechanically-stirring unit with a rotating blade, such as a homomixer and a homogenizer, and a vibration imparting unit such as an ultrasonic homogenizer. When a strong shearing stress is applied to the softening agent in the fixing liquid with any of the units, the softening agent is dissolved or microemulsion-dispersed.

Furthermore, the fixing unit that fixes toner may have a pair of smoothing rollers (hard rollers) that pressurize the toner dissolved or swelled with an agent (softening agent) for dissolving or swelling at least a part of the resin contained in the toner after the fixing liquid according to the embodiment of the present invention is supplied to the toner. By pressurizing the dissolved or swelled toner with the pair of smoothing rollers, the fixing unit can smooth the surface of the layer of the dissolved or swelled toner and give a gloss to the toner. Moreover, by pushing the dissolved or swelled toner into a recording medium, the fixing unit can improve the fixing performance of the toner to the recording medium.

With the image forming method according to the embodiment of the present invention described above, a resin-containing toner image is formed on a recording medium. According to this embodiment of the present invention, it is possible to provide the image forming method and the image forming apparatus capable of more efficiently fixing the toner to the recording medium.

Figure 9A:
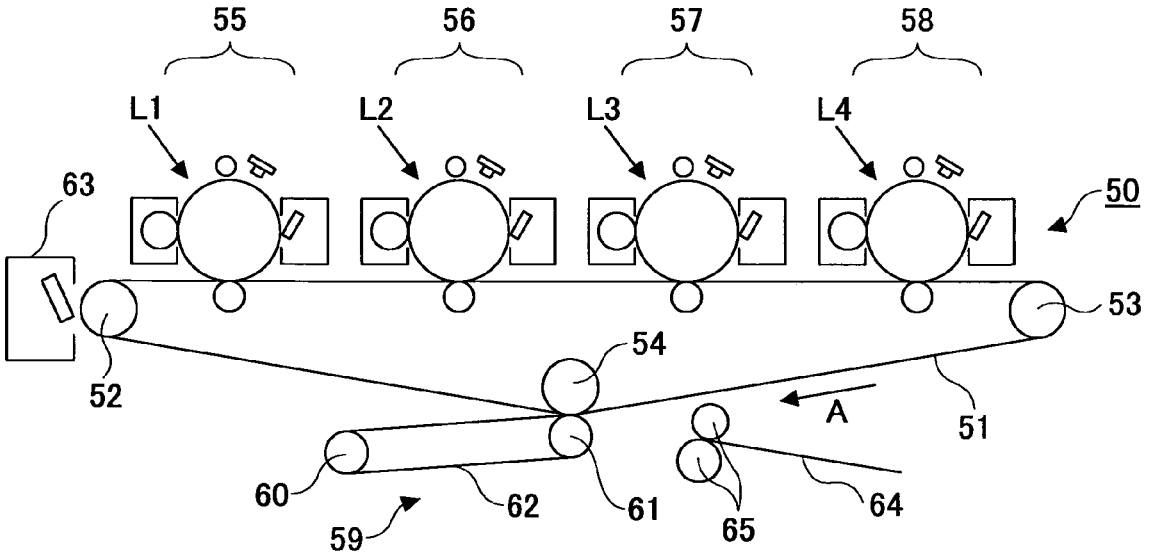
FIGS. 9A and 9B are schematic views showing the configuration of an image forming apparatus according to another invention.
Figure 9B:
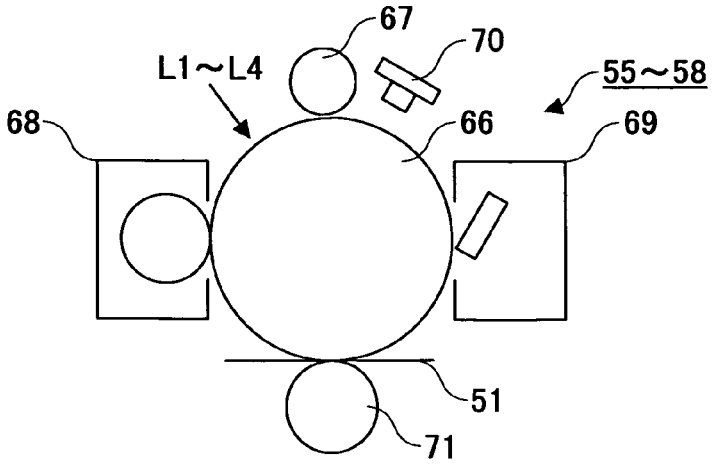

FIGS. 9A and 9B are schematic diagrams showing the configuration of an image forming apparatus according to another invention. The image forming apparatus shown in FIGS. 9A and 9B may be a copier or a printer. FIG. 9A is the schematic diagram showing as a whole the image forming apparatus of a color electrophotographic and tandem type. FIG. 9B is the schematic diagram showing the configuration of one image forming unit of the image forming apparatus shown in FIG. 9A. The image forming apparatus 50 shown in FIGS. 9A and 9B has an intermediate transfer belt 51 as a toner image carrier. The intermediate transfer belt 51 is stretched on three supporting rollers 52 through 54 and rotates in the direction indicated by arrow A. With respect to the intermediate transfer belt 51, image forming units 55 through 58 for black, yellow, magenta, and cyan, respectively, are aligned. Above the image forming units, an exposure unit not shown is arranged. For example, when the copier serves as the image forming apparatus, a scanner scans image information on a document, and then the exposure unit applies light beams L1 through L4 for writing electrostatic latent images to photosensitive drums in accordance with the image information. At the position opposite to the supporting roller 54 via the intermediate transfer belt 51, a secondary transfer unit 59 is provided. The secondary transfer unit 59 is composed of a secondary transfer belt 62 stretched between the two supporting rollers 60 and 61. Note that as the secondary transfer unit 59, a transfer roller may be used instead of the transfer belt. Furthermore, at the position opposite to the supporting roller 52 via the intermediate transfer belt 51, a belt cleaning unit 63 is provided. The belt cleaning unit 63 is arranged to remove the toner remaining on the intermediate transfer belt 51.

A recording sheet 64 as the recording medium is guided to a secondary transfer unit by a pair of sheet feeding rollers 65. When a toner image is transferred onto the recording sheet 64, the secondary transfer belt 62 is pressed against the intermediate transfer belt 51. The recording sheet 64, onto which the toner image is transferred, is conveyed by the secondary transfer belt 62. The unfixed toner image transferred onto the recording sheet 64 is fixed by the fixing unit according to the embodiment of the present invention, which controls the film thickness of the layer of the foamed fixing liquid based on image information from the exposure unit not shown. In other words, the foamed fixing liquid according to the embodiment of the present invention, which is supplied from the fixing unit and of which the film thickness is controlled based on the image information such as a color image and a black solid image from the exposure unit not shown, is applied to the unfixed toner image transferred onto the recording sheet 64. Then, the unfixed toner image is fixed to the recording sheet 64 with the agent (softening agent), which is contained in the foamed fixing liquid and dissolves or swells at least a part of the resin contained in the toner.

Next, the image forming units are described. As shown in FIG. 9B, each of the image forming units 55 through 58 has a charging unit 67, a developing unit 68, a cleaning unit 69, and an electrostatic removing unit 70 around a photosensitive drum 66. Furthermore, a primary transfer unit 71 is provided at the position opposite to the photosensitive drum 66 via the intermediate transfer belt 51. Furthermore, the charging unit 67 is a contact-charging-type charging unit using a charging roller. The charging unit 67 uniformly charges the surface of the photosensitive drum 66 by causing the charging roller to come into contact with the photosensitive drum 66 to apply a voltage to the photosensitive drum 66. As the charging unit 67, a non-contact-charging-type charging unit using a non-contact scorotron, etc., may be used. Furthermore, the developing unit 68 causes the toner of a developing agent to adhere to an electrostatic latent image on the photosensitive drum 66 to visualize the electrostatic latent image. Here, the toner corresponding to each of the colors is formed of a resin material pigmented in the color involved, and the resin material is dissolved or swelled by the fixing liquid according to the embodiment of the present invention. Note that the developing unit 68 has a stirring unit and a developing unit not shown. In the developing unit 68, the developing agent not used for image development is returned to the stirring unit and reused. The concentration of the toner in the stirring unit is detected by a toner concentration sensor and controlled to be constant. Moreover, the primary transfer unit 71 transfers the toner visualized on the photosensitive drum 66 onto the intermediate transfer belt 51. Here, a transfer roller is used as the primary transfer unit 71 and pressed against the photosensitive drum 66 via the intermediate transfer belt 51. As the primary transfer unit 71, a conductive brush, a non-contact corona charger, etc., may be used. Furthermore, the cleaning unit 69 removes unnecessary toner from the photosensitive drum 66. As the cleaning unit 69, a blade whose tip end is pressed against the photosensitive drum 66 may be used. Here, the toner collected by the cleaning unit 69 is returned to the developing unit 68 by a collecting screw and toner recycling unit not shown, and then reused. Moreover, the electrostatic removing unit 70 is constituted of a lamp and radiates light to initialize the surface potential of the photosensitive drum 66.

Next, a description is made of a specific example of the fixing liquid and the fixing of the fixing liquid according to the embodiment of the present invention.

Specific Example 1

(Ingredients of Fixing Liquid)

Preparation of Fatty Acid Salts

Myristic acid potassium (reagent by Wako Pure Chemical Industries, Ltd.): 2.0 g

Palmitic acid potassium (reagent by KANTO CHEMICAL CO., INC.): 1.5 g

Stearic acid potassium (reagent by KANTO CHEMICAL CO., INC.): 0.5 g

Preparation of Fatty Acids

As described in table 1 below, fatty acids were prepared in accordance with molar ratios for each carbon number based on the ratios of the fatty acids.

TABLE 1

| | MOLAR RATIO OF FATTY ACID TO FATTY ACID SALT | | | | |
|---|---|---|---|---|---|
| FATTY ACIDS | 0:10 | 1:9 | 3:7 | 5:5 | 6:4 |
| MYRISTIC ACID (REAGENT BY KANTO CHEMICAL CO., INC.) | 0 g | 0.19 g | 0.73 g | 1.71 g | 2.57 g |
| PALMITIC ACID (REAGENT BY KANTO CHEMICAL CO., INC.) | 0 g | 0.15 g | 0.56 g | 1.31 g | 1.96 g |
| STEARIC ACID (REAGENT BY KANTO CHEMICAL CO., INC.) | 0 g | 0.05 g | 0.19 g | 0.44 g | 0.66 g |

Dilution solvent: remaining amount g of ion-exchange water

Softening agent: 10 g of diethoxyethyl succinate (Croda DES by Croda Corporation) and 30 g of propylene carbonate (ASAHINATE by ASAHI GLASS CO., LTD.)

Solubilizing agent: 10 g of propylene glycol

Foam increasing agent: 0.5 g of 1:1 type coconut fatty acid diethanol amide (MAPON MM by Matsumoto Yushi-Seiyaku Co., Ltd.)

Under the above component ratio, the ion-exchange water was first heated to 80° C., and the fatty acid salts prepared with the above ratio were then successively added to the ion-exchange water. After that, the fatty acids prepared with the above ratio were successively added to the mixture. After being stirred with a stirrer for 30 minutes at 100 rpm, propylene glycol was added to the mixture. The mixture was then naturally cooled to room temperature. After being cooled, the softening agents were successively added to the mixture. Finally, the foam increasing agent was added to the mixture. The mixture was stirred with the stirrer for 5 minutes at 100 rpm and then stirred with an ultrasonic homogenizer for 10 minutes. Thus, a fixing liquid (undiluted solution) in which the softening agents were completely dissolved was manufactured.

Large Foam Generation Unit

The foamed fixing liquid was manufactured using the foamed fixing liquid generation unit shown in FIG. 4.

Aquiform fixing liquid storage container: bottle made of PET resin

Liquid conveyance pump: tube pump (tube inner diameter: 2 mm, tube material: silicon rubber)

Conveyance path: silicon rubber tube having an inner diameter of 2 mm

Minute hole sheet for generating large foam: #400 stainless steel mesh sheet (having an opening part of about 40 μm)

Minute Foam Generation Unit

The foamed fixing liquid was manufactured using the foamed fixing liquid generation unit shown in FIG. 4.

The inner cylinder of the double cylinder structure was fixed to the rotating shaft and rotated with a rotation driving motor not shown. The material of the double cylinder structure was PET resin. The double cylinder structure was so arranged that the outer cylinder had an inner diameter of 10 mm and a length of 120 mm and the inner cylinder had an outer diameter of 8 mm and a length of 100 mm. In addition, the double cylinder structure was configured to rotate for 10 minutes at 300 rpm.

Table 2 shows the results when foams are generated using the fixing liquids.

TABLE 2

| MOLAR RATIO OF FATTY ACID TO FATTY ACID POTASSIUM | FOAM DENSITY ($g/cm^3$) | FOAM STATUS |
|---|---|---|
| 0:10 | 0.040 | X |
| 1:9 | 0.018 | ○ |
| 3:7 | 0.013 | ○ |
| 5:5 | 0.019 | ○ |
| 6:4 | 0.030 | X |

Note that the foam status "X" represents poor foaming stability in which foams disappeared when they were left alone for 1 minute.

In the case of the coating roller, the thickness of the foam film of the fixing liquid on the surface of the contact application unit must be greater than or equal to the thickness of the fine particles layer on the medium (so that the gaps between the fine particles layers are filled with the foamed fixing liquid). Therefore, the thickness of the foam film is preferably in the range of about 50 μm through 80 μm. On the other hand, in order to prevent the residual liquid feeling (wet feeling) due to the adhesion of the fixing liquid to the medium surface, the adhesion amount of the fixing liquid is preferably 0.1 mg/cm$^2$ or smaller. For this reason, the density of foams must be in the range of 0.125 g/cm$^3$ through 0.02 g/cm$^3$, at least 0.02 g/cm$^3$ or smaller.

As shown in Table 2, in order to obtain a desired foam density of 0.02 g/cm$^3$ or smaller, the molar ratio of the fatty acid to the fatty acid potassium was in the range of 5:5 through 1:9. Furthermore, even if a foaming time (rotating time) was set to be 5 minutes, the molar ratio of the fatty acid to the fatty acid potassium was in the range of 5:5 through 1:9 to obtain the foam density smaller than or equal to 0.02 g/cm$^3$ in the above range, thereby providing an excellent foaming time. Moreover, the foaming stability was extremely excellent. Furthermore, when the molar ratio of the fatty acid to the fatty acid potassium are 1:9, 3:7, and 5:5, the fatty acid is contained in an amount of about 11, 43, and 100 moles, respectively, provided that the fatty acid potassium is 100 moles. On the other hand, an extremely small amount causing a pH change as the description content on the additive of fatty acid using the super fat described in Non-Patent Document 1 is based on 100 moles of fatty acid potassium. In this case, the fatty acid has about several moles at most. As opposed to this, the number of moles of the fatty acid contained in the fixing liquid according to the embodiment of the present invention is enormous. This is because the fatty acid and the softening agent act together as described above.

Furthermore, when propylene glycol as the solubilizing agent was removed in the ingredients of the fixing liquid, the foam density where the molar ratio of the fatty acid to the fatty acid potassium was in the range of 5:5 through 1:9 increased by about 30%. Accordingly, it was found that the foaming property of the fixing liquid was increased with the addition of propylene glycol.

Specific Example 2

(Ingredients of Fixing Liquid)

Fatty acid was subjected to saponification reaction with triethanol amine so as to have a saponification degree of 99%. Then, fatty acid amine and unsaponified fatty acid were manufactured in accordance with the molar ratio of the fatty acid to the triethanol amine without being purified. Thus, the fixing liquid in which the fatty acid salt (fatty acid amine) and the fatty acid were mixed together was manufactured.

Here, the mixing ratio of the fatty acid to the triethanol amine is shown in table 3 below. Note that the ingredients of the fatty acid in table 3 were prepared by the following substances.

Myristic acid: 2.0 g

Palmitic acid: 1.5 g

Stearic acid: 0.5 g

TABLE 3

| MOLAR RATIO OF FATTY ACID TO TEA | 1:1 | 1:0.9 | 1:0.7 | 1:0.5 | 1:0.4 |
|---|---|---|---|---|---|
| TEA AMOUNT IN FIXING LIQUID | 2.44 g | 2.20 g | 1.71 g | 1.22 g | 0.98 g |
| MOLAR RATIO OF FATTY ACID TO FATTY ACID AMINE | 0:10 | 1:9 | 3:7 | 5:5 | 6:4 |

Dilution solvent: remaining amount g of ion-exchange water

Softening agent: 40 g of propylene carbonate (ASAHINATE by ASAHI GLASS CO., LTD.)

Solubilizing agent: 10 g of propylene glycol

Foam increasing agent: 0.5 g of 1:1 type coconut fatty acid diethanol amide (MAPON MM by Matsumoto Yushi-Seiyaku Co., Ltd.)

Under the above component ratio, the ion-exchange water was first heated to 80° C., and the fatty acid salts prepared with the above ratio were then successively added to the ion-exchange water. After that, the fatty acids prepared with the above ratio were successively added to the mixture. After being stirred with a stirrer for 30 minutes at 100 rpm, propylene glycol was added to the mixture. The mixture was then naturally cooled to room temperature. After being cooled, the softening agents were successively added to the mixture. Finally, the foam increasing agent was added to the mixture. The mixture was stirred with the stirrer for 5 minutes at 300 rpm and then stirred with an ultrasonic homogenizer for 10 minutes. Thus, the fixing liquid (undiluted solution) in which the softening agents were completely dissolved was manufactured. The completed fixing liquid was subjected to the foamed fixing liquid generation unit as in specific example 1. Table 4 shows the results in which the foam density of the foamed fixing liquid was measured.

TABLE 4

| MOLAR RATIO OF FATTY ACID TO POTASSIUM FATTY ACID | FOAM DENSITY (g/cm$^3$) | FOAM STATUS |
|---|---|---|
| 0:10 | 0.050 | X |
| 1:9 | 0.018 | ○ |
| 3:7 | 0.015 | ○ |
| 5:5 | 0.019 | ○ |
| 6:4 | 0.060 | X |

Note that the foam status "X" represents poor foaming stability in which foams disappeared when they were left alone for 1 minute.

In the case of the coating roller, the thickness of the foam film of the fixing liquid on the surface of the contact application unit must be greater than or equal to the thickness of the fine particles layer on the medium (so that the gaps between the fine particles layers are filled with the foamed fixing liquid). Therefore, the thickness of the foam film is preferably in the range of about 50 μm through 80 μm. On the other hand, in order to prevent the residual liquid feeling (wet feeling) due to the adhesion of the fixing liquid onto the medium surface, the adhesion amount of the fixing liquid is preferably 0.1 mg/cm$^2$ or smaller. For this reason, the density of foams must be in the range of 0.125 g/cm$^3$ through 0.02 g/cm$^3$, at least 0.02 g/cm$^3$ or smaller.

As shown in Table 4, in order to obtain a desired foam density 0.02 g/cm$^3$ or smaller, the molar ratio of the fatty acid to the fatty acid salt was in the range of 5:5 through 1:9. Furthermore, even if a foaming time (rotating time) was set to be 5 minutes, the molar ratio of the fatty acid to the fatty acid potassium was in the range of 5:5 through 1:9 to obtain the foam density smaller than or equal to 0.02 g/cm$^3$ in the above range, thereby providing an excellent foaming time. Moreover, the foaming stability was extremely excellent.

Specific Example 3

Ingredients of Fixing Liquid and Manufacturing of Foamed Fixing Liquid

Same as Specific Example 2

Fixing Liquid Application Unit

The foamed fixing liquid was manufactured using the foamed fixing liquid generation unit shown in FIGS. 5A and 5B. The fixing liquid application unit was configured to generate the foamed fixing liquid and supply it to the blade. The gap between the blade and the coating roller was set to be 40 μm.

Pressurizing roller: sponge roller having an aluminum alloy roller (ϕ10 mm) as a cored bar and made of a polyurethane foam material ("color foam EMO" by INOAC CORPORATION) whose outer diameter is ϕ50 mm Coating roller: SUS roller (ϕ30 mm) on which PFT resin was baking-finished Film thickness controlling blade: plate glass having a thickness of 1 mm was bonded to an aluminum alloy supporting plate. With its glass surface directed to the coating roller, the film thickness controlling blade was configured to control the gap between the coating roller and the glass surface in the range of 10 μm through 100 μm.

Sheet conveyance speed: 150 mm/s (Results)

Using an electrophotographic printer (Ipsio Color CX 8800 by Ricoh Company, Ltd.), a PPC sheet (T-6200 by Ricoh Company, Ltd.) on which a color image of unfixed toner was formed was inserted into the fixing unit. The thickness of the toner layer was in the range of 30 μm through 40 μm. The thickness of the foamed fixing liquid on the coating roller was about 70 μm.

Table 5 shows the evaluation results when the fixing liquid is fixed.

TABLE 5

| MOLAR RATIO OF FATTY ACID TO FATTY ACID POTASSIUM | APPLICATION AMOUNT OF FIXING LIQUID TO SHEET (MG/A4 TYPE) | IMAGE QUALITY AFTER FIXING |
|---|---|---|
| 0:10 | 350 | X: SHEET WAS WET AND CURLED. IMAGE WAS DELETED. SHEETS WERE STUCK TO EACH OTHER WHEN BEING OVERLAPPED. |
| 1:9 | 90 | ○: EXCELLENT IMAGE. SHEET WAS NOT WET AND CURLED. NO PROBLEM OCCURRED WHEN SHEETS WERE OVERLAPPED. |
| 3:7 | 80 | ○: EXCELLENT IMAGE. SHEET WAS NOT WET AND CURLED. NO PROBLEM OCCURRED WHEN SHEETS WERE OVERLAPPED. |
| 5:5 | 100 | ○: EXCELLENT IMAGE. SHEET WAS NOT WET AND CURLED. NO PROBLEM OCCURRED WHEN SHEETS WERE OVERLAPPED. |
| 6:4 | 400 | X: SHEET WAS WET AND CURLED. IMAGE WAS DELETED. SHEETS WERE STUCK TO EACH OTHER WHEN BEING OVERLAPPED. |

As is apparent from table 5, the fixing of the fixing liquid itself was performed at any ratio of the fatty acid to the fatty acid potassium. However, at the ratios of 0:10 and 4:6, the application amount of the fixing liquid to the sheet was extremely large in accordance with the density shown in specific example 1. Since the sheet was wet immediately after the fixing of the fixing liquid, it was curled. Furthermore, since an excessive fixing liquid was applied to the sheet, a toner image was remarkably softened to be sticky. Therefore, printing sheets were stuck to each other when they were overlapped. On the other hand, at the ratios of 1:9, 3:7, and 5:5, the sheet was not wet at all and curled. Therefore, the fixing of an image was successfully performed without causing the sheet to be sticky.

According to the fixing liquid of the embodiment of the present invention, it is possible to prevent the offset of resin-containing fine particles to the foamed fixing liquid application unit when the foamed fixing liquid is applied to the resin-containing fine particles layer, realize the application of a small amount of the fixing liquid in a stable manner, and non-thermally fix the fixing liquid with extremely lower power than conventional arts. Moreover, the fixing liquid contains fatty acid in addition to a fatty acid salt as a foaming agent, thereby making it possible to manufacture the foamed fixing liquid having desired foam density in a relatively short period of time. Accordingly, a start-up time of the fixing unit is reduced, the foaming stability is extremely improved, and reliability in the application of the small amount of the fixing liquid is remarkably improved.

The present invention is not limited to the specifically disclosed embodiments, and variations and modifications may be made without departing from the scope of the present invention.

The present application is based on Japanese Priority Application No. 2008-102005 filed on Apr. 10, 2008, with the Japan Patent Office, the entire contents of which are hereby incorporated by reference.

The invention claimed is:

1. A fixing liquid comprising:

a softening agent;

a fatty acid that is at least one member selected from the group consisting of myristic acid, palmitic acid, and stearic acid; and a fatty acid potassium;

wherein the fatty acid potassium and the fatty acid are mixed in a mixing ratio such that a ratio of a number of moles of the fatty acid to a number of moles of the fatty acid potassium is in a range of 1:9 through 5:5.

2. The fixing liquid according to claim 1, further comprising a polyhydric alcohol.

3. The fixing liquid according to claim 1, wherein the softening agent is fatty acid alkoxyalkyl.

4. The fixing liquid according to claim 1, wherein the softening agent is ester carbonate.

5. The fixing liquid of claim 1 on a recording medium.

6. The fixing liquid of claim 1, wherein the softening agent softens a fine particle resin composition by dissolving or swelling at least a part of the resin.

7. The fixing liquid of claim 1, wherein the water serves as a dilution solvent.

* * * * *